US005639999A

United States Patent [19]

Hsu

[11] Patent Number: 5,639,999

[45] Date of Patent: Jun. 17, 1997

[54] UNIVERSALLY TILTED INCLINATION SWITCH

[76] Inventor: Yu-Liang Hsu, C/O Hung Hsing Patent Service Center P.O. Box 55-1670, Taipei, Taiwan

[21] Appl. No.: 546,977

[22] Filed: Oct. 23, 1995

[51] Int. Cl.[6] ..... H01H 35/02

[52] U.S. Cl. ..... 200/61.52

[58] Field of Search ..... 200/61.45 R–61.45 M; 307/119–124

[56] References Cited

U.S. PATENT DOCUMENTS

| | | | |
|---|---|---|---|
| 3,621,163 | 11/1971 | Hitchcock | 200/61.45 |
| 3,812,308 | 5/1974 | Bell et al. | 200/61.45 R |
| 3,818,160 | 6/1974 | Hitchcock | 200/61.45 R |
| 4,533,801 | 8/1985 | Jackman et al. | 200/61.45 R |
| 4,618,746 | 10/1986 | Schwob et al. | 200/61.45 R |
| 4,859,818 | 8/1989 | Landais | 200/61.45 R |
| 5,237,135 | 8/1993 | Wolski | 200/61.45 R |
| 5,477,019 | 12/1995 | Dolling | 200/61.48 |

*Primary Examiner*—Michael L. Gellner
*Assistant Examiner*—Michael A. Friedhofer

[57] ABSTRACT

A universally tilted inclination switch includes: a housing having a conical recess recessed downwardly in the housing, an actuating ball gravitationally rested on a central portion of the conical recess of the housing, a pair of terminals electrically connected to two poles of a power source of an electrical circuit, and a conducting disk normally gravitationally riding on the pair of terminals for electrically contacting the pair of terminals for closing the electrical circuit, whereby upon tilting of the housing to move the actuating ball, the conducting disk will be upwardly biased to disconnect the pair of terminals to open the circuit, thereby providing an inclination switch universally tilted to any orientation about the vertical axis for a more sensitive actuation of the switch for opening or closing the electrical circuit.

9 Claims, 7 Drawing Sheets

UNIVERSALLY TILTED INCLINATION SWITCH

BACKGROUND OF THE INVENTION

U.S. Pat. No. 5,209,343 to Robert P. Romano et al disclosed an electrical tilt switch having at least one conductive weight ball held within a housing with the weight ball free moving from one end of the housing to the other end as the angle of inclination of the housing is changed. As the weight abuts against the terminals, electricity is conducted through the weight from one terminal to the other to complete an electrical circuit.

Such a conventional tilt switch is illustrated as shown in FIG. 11, wherein if the elongate housing 14 is tilted about the Z-axis, the weight balls 30 (as positioned at the location as shown in dotted line) will free move to contact the conductive housing 14, connected to one terminal 34, with the other terminal 24 secured at the insulative end cap member 18, the circuit will then be closed between the two terminals 34, 24.

However, when the balls 30 are originally held at the left side of a horizontal housing adjacent to the terminal 34 (as shown in solid line of FIG. 11) and the housing 14 is tilted about the X-axis, the balls 30 on the left side will not move towards the right side to conduct the terminal 24, thereby causing limitation for responding the inclination orientations and possibly influencing the operational reliability of the tilt switch.

SUMMARY OF THE INVENTION

The object of the present invention is to provide a universally tilted inclination switch including: a housing having a conical recess recessed downwardly in the housing, an actuating ball gravitationally rested on a central portion of the conical recess of the housing, a pair of terminals electrically connected to two poles of a power source of an electrical circuit, and a conducting disk normally gravitationally riding on the pair of terminals for electrically contacting the pair of terminals for closing the electrical circuit, whereby upon tilting of the housing about a vertical axis intersecting a conical center of the conical recess to move the actuating ball, the conducting disk will be upwardly biased to disconnect the pair of terminals to open the circuit, thereby providing an inclination switch universally tilted to any orientation about the vertical axis for a more sensitive actuation of the switch for opening or closing the electrical circuit.

DETAILED DESCRIPTION

Figure 1:
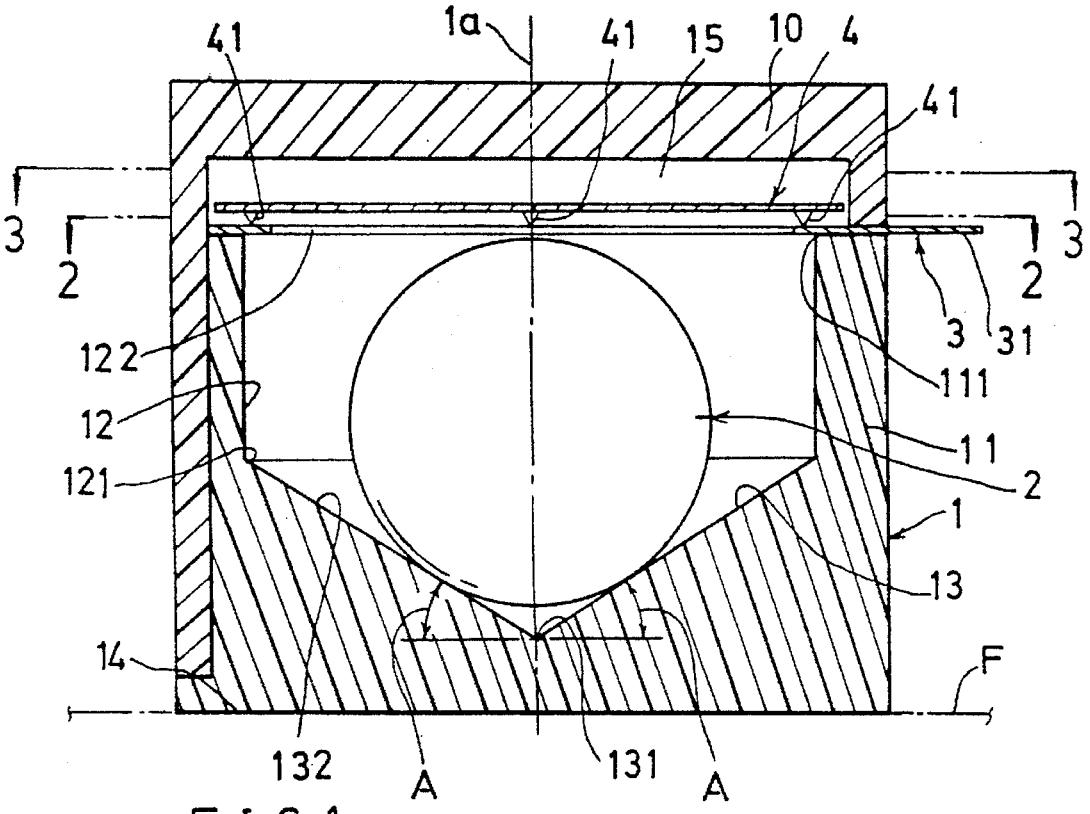
FIG. 1 is a sectional drawing of the present invention.
Figure 2:
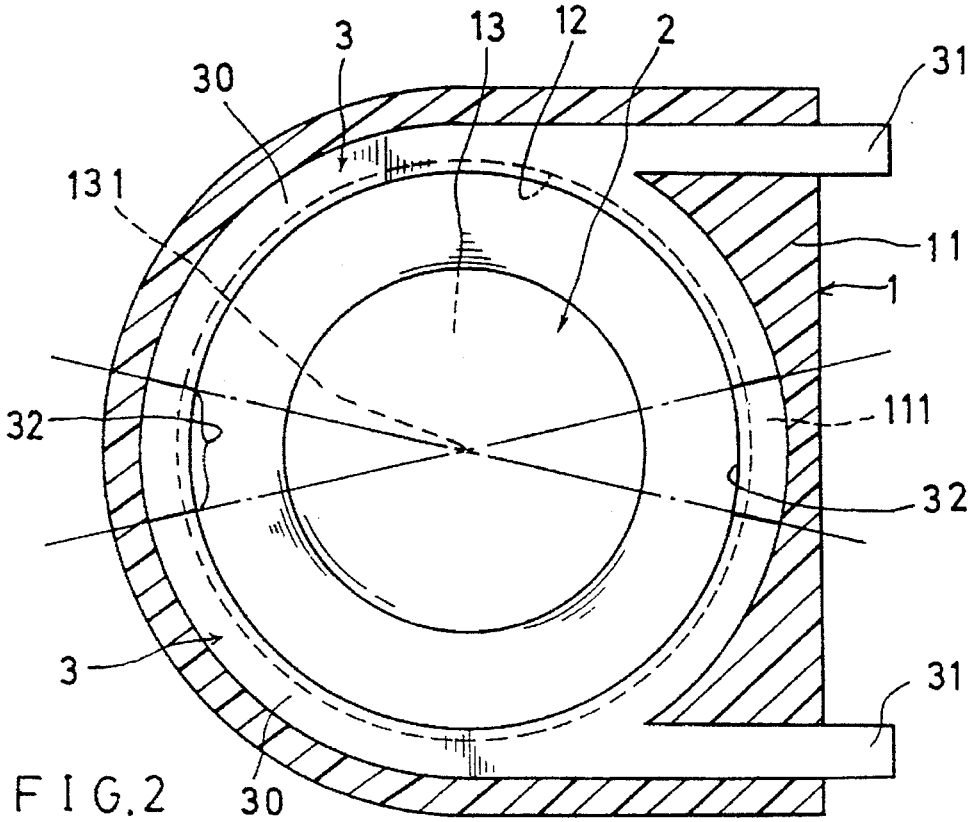
FIG. 2 is a top view illustration when viewed from 2—2 direction of FIG. 1.
Figure 3:
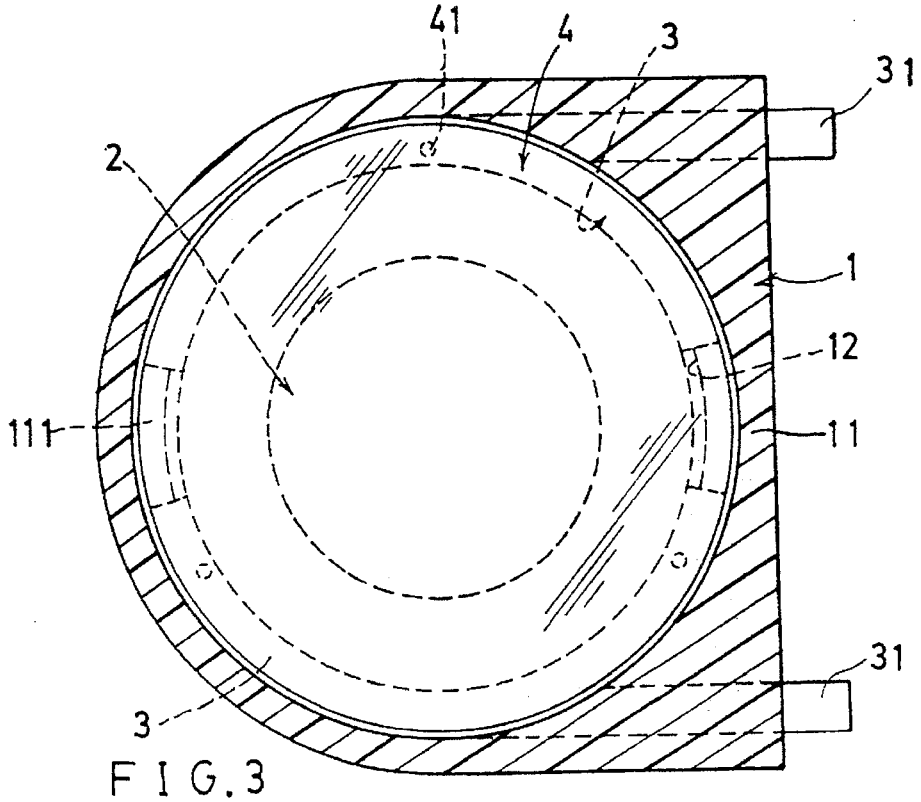
FIG. 3 is a top view illustration when viewed from 3—3 direction of FIG. 1.

As shown in FIGS. 1–9, the inclination switch of the present invention comprises: a housing 1, an actuating ball 2 held and moving in the housing 1, a pair of terminals separately secured on an upper portion of the housing and respectively electrically connected to two poles of a power source of an electrical circuit (not shown), and a conducting disk 4 gravitationally riding on the pair of terminals 3.

The shapes of the elements in construction of the present invention are not limited in this invention.

The housing 1 is made of electrically insulative material and includes: a main body 11 having a cylindrical cavity 12 recessed downwardly from an upper rim portion 111 of the main body 11, a conical recess 13 recessed downwardly from a lower periphery 121 of the cylindrical cavity 12 defining a vertical axis 1*a* longitudinally intersecting a conical center 131 at a lowest center of the conical recess 13 and having a conical sloping surface 132 circumferentially formed on the conical recess 13, a horizontal bottom 14 formed at a bottom portion of the main body 11 to be held on a supporting surface F, and a cover 10 encasing the main body 11 and defining a biasing chamber 15 between the cover 10 and the upper rim portion 111. The conical sloping surface 132 has an inclination angle A tilted from the horizontal bottom 14 for an acute angle.

Figure 5:
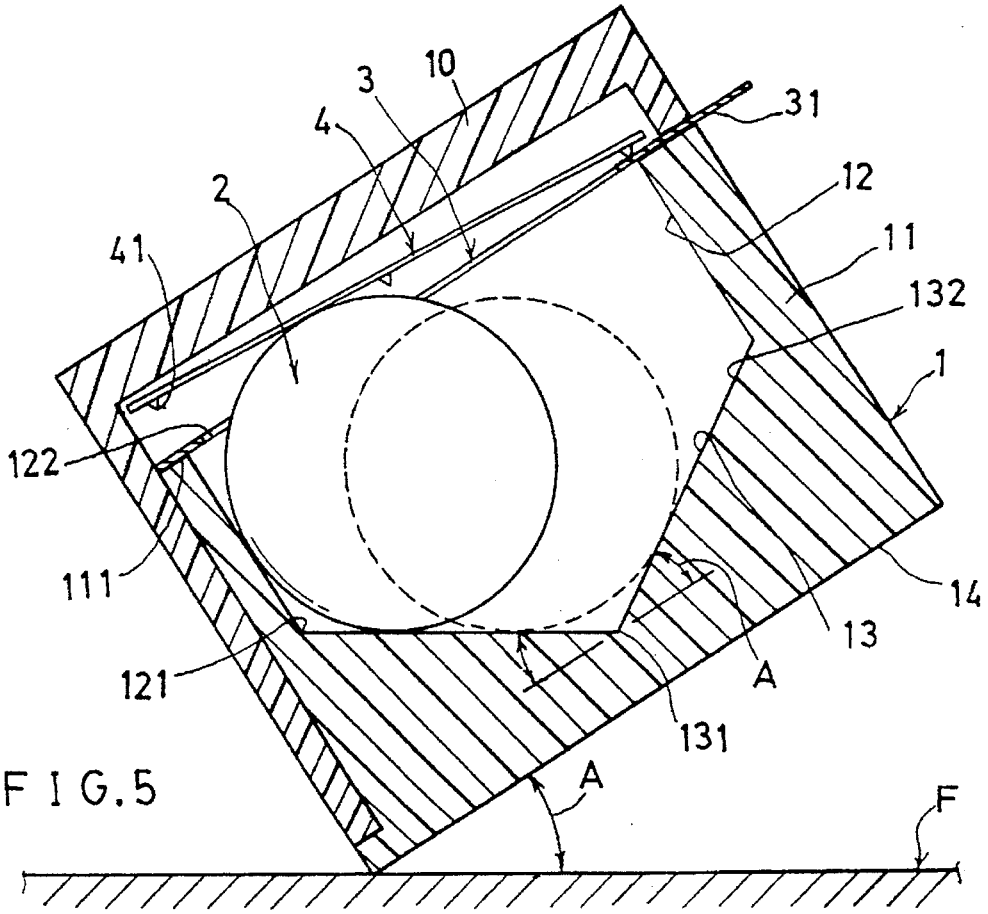
FIG. 5 is an illustration when tilting the present invention while remaining one protrusion of the conducting disk rested on the terminals.
Figure 4:
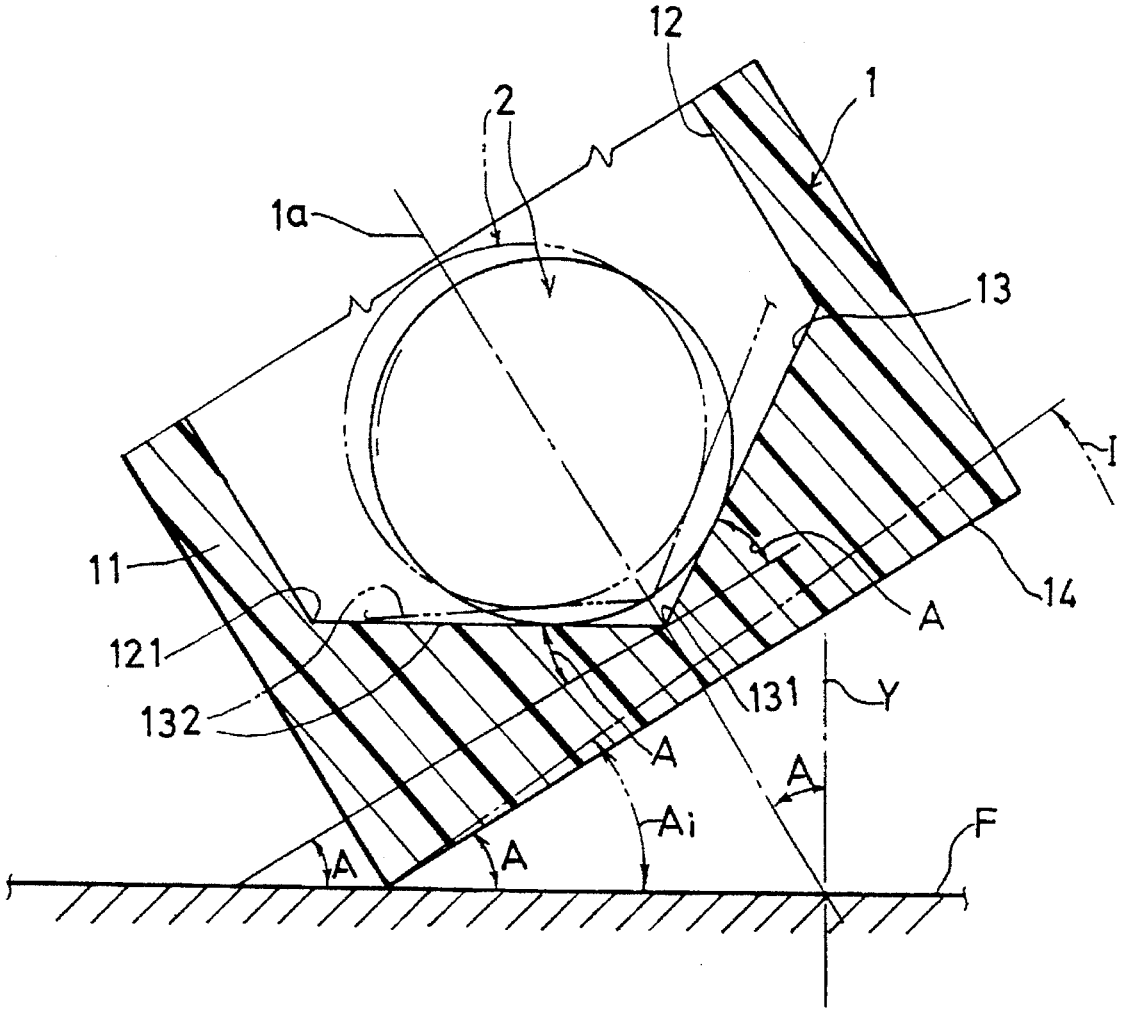
FIG. 4 is an illustration when tilting the present invention for initiating the actuation of the switch.

The actuating ball 2 is formed with an appreciated weight and gravitationally rests on the conical recess 13 in the housing 1, having a diameter or height of the ball lower than the upper rim portion 111 of the housing. The ball 2 moves or rolls on the sloping surface 132, when tilting the housing 1 as shown in FIGS. 4, 5, in the conical recess 12 and is finally braked on a corner adjacent to the cylindrical lower periphery 121 between the cylindrical cavity 12 and the conical recess 13 to have an upper spherical portion of the ball 2 to lift the conducting disk 4 upwardly through an upper central opening 122 of the main body 11 in order to leave the pair of terminals 3 to disconnect the terminals 3 for opening the electrical circuit provided with the inclination switch of the present invention. The less degrees of the inclination angle A is set, the ball 2 will be moved to disconnect the terminals 3 more easily.

The pair of terminals 3 are disposed and generally circumferentially secured on the upper rim portion 111 of the housing 1. The terminals 3 are electrically conductive.

Each terminal 3 includes: an arcuate contactor 30 secured, printed or integrally formed on the upper rim portion 111 of the housing 1, and a contactor lead 31 protruding outwardly from the arcuate contactor 30 to be connected with the electrical circuit and power source.

The two terminals 3 may be separated each other for an acute separating angle C (FIG. 8), or may be separated by a pair of insulative spacers 32 each defined within the separating angle C. The spacer 32 may also be directly integrally formed on the upper rim portion 111 of the housing 1. Other modifications for securing the terminals 3 in the housing may be made.

The conducting disk 4 is preferably formed as a circular shape as shown in the drawing figures, and may also be modified to be other suitable shapes, not limited in this invention.

The conducting disk 4 is made of electrically conductive material and is formed with a plurality of contacting protrusions 41 each protrusion 41 protruding downwardly from a peripheral bottom portion of the disk 4 to be rested on the pair of terminals 3, the spacers 32 or the upper rim portion 111 of the housing 1.

Figure 8:
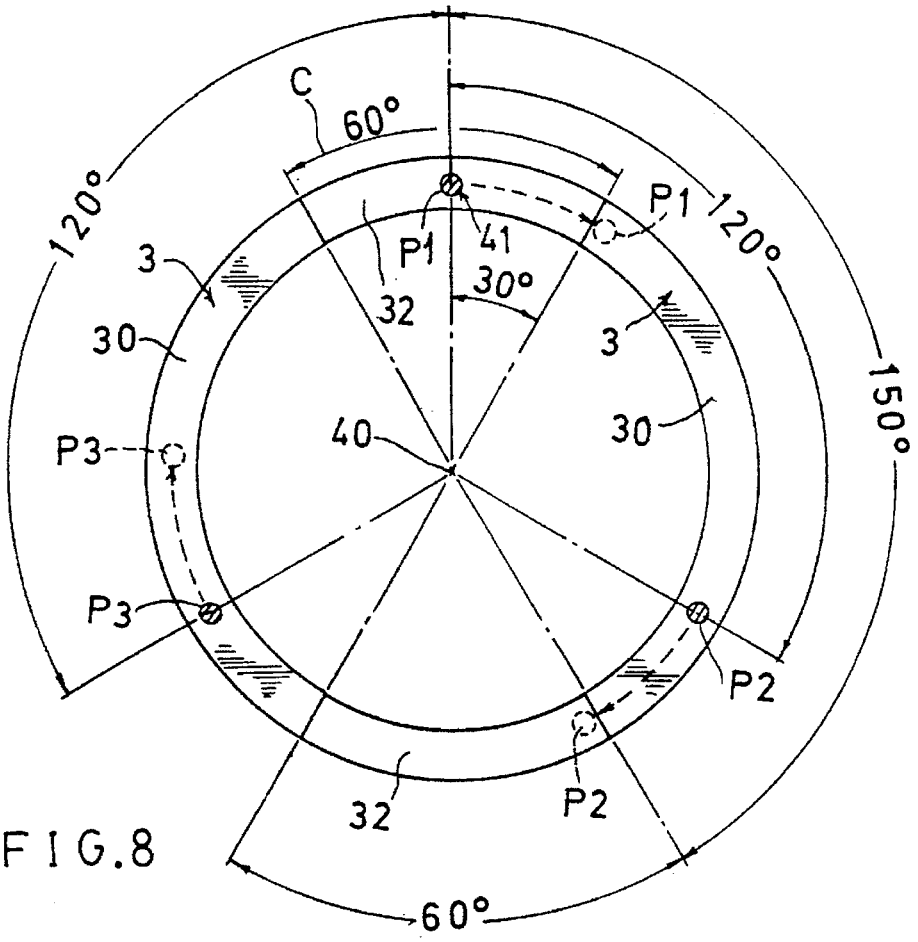
FIG. 8 is a top view illustration showing the relationship of the protrusions of the conductive disk with the pair of terminals of the present invention.
Figure 9:
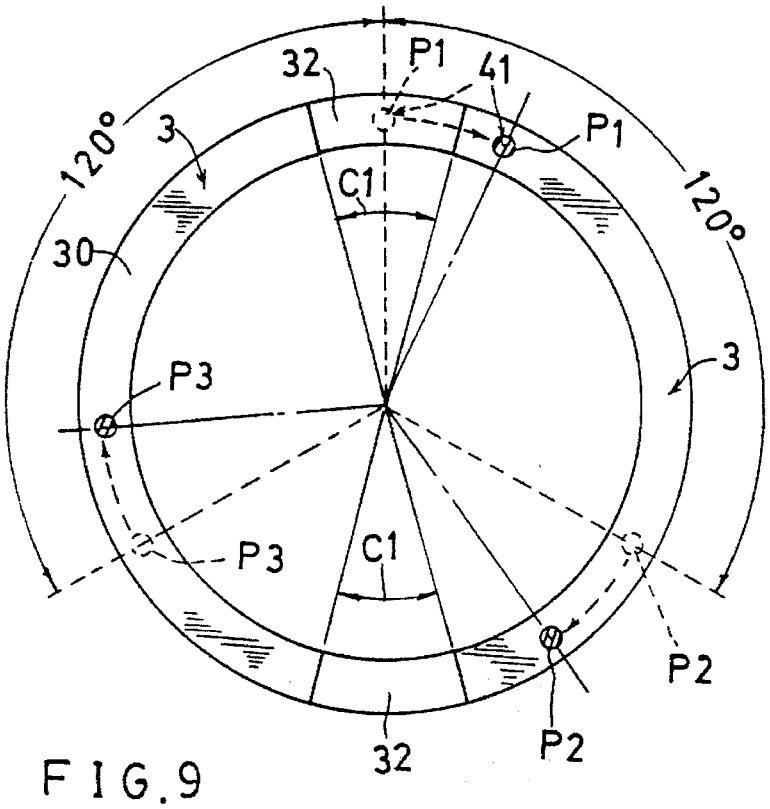
FIG. 9 shows another relationship of the protrusions of the conducting disk with the terminals.

The number of contacting protrusions 41 are not limited and are preferably at least three protrusions 41 with every two neighboring protrusions 41 separating with each other at an angle of 120 degrees about a disk center 40 as shown in FIGS. 8, 9.

The three protrusions 41 of the conducting disk 4 may always have two protrusions distributed in the two arcuate contactors 30 of the pair of terminals 3 as shown in FIGS. 8, 9 if the separating angle C is defined to be 60 degrees (FIG. 8) or even a "small angle" less than 60 degrees (FIG. 9) to shorten the spacer 32.

As shown in FIG. 8, if a first protrusion P1 of the disk protrusion 41 is located at a center of the spacer 32 and the separating angle C now designated as 60 degrees, two ends of each arcuate contactor 30 of the terminal 3 will be separated from the first protrusion P1 in a range from 30 degrees to 150 degrees. Since the second protrusion P2 or third protrusion P3 is separated from the first protrusion P1 in an angle of 120 degrees, within the range of 30–150 degrees of each contactor 30 of the terminal 3, the two protrusions P2, P3 of the conducting disk 4 will be absolutely fallen in the two contactors 30 to ensure the closing of the two terminals 3 for normally closing the circuit when the conducting disk 4 gravitationally rests upon the terminals 3, the spacer 32 or the upper rim portion 111 of the housing.

A clockwise rotation of the disk 4 to position the triple protrusions P1, P2, P3 as shown in dotted line of FIG. 8 to allow P1 to be exactly distributed at a margin of the contactor 30 of one terminal, the other protrusion P3 will be fallen in the other terminal 3 to ensure a normal shortcircuiting of the circuit by electrically conducting the two terminals 3 by the conducting disk 4 gravitationally resting upon the terminals 3.

As shown in FIG. 9, even two protrusions P1, P2 are simultaneously fallen into the right side arcuate contactor 30, another protrusion P3 will, no doubt, be falled into the other contactor 30 since each contactor 30 will define an angle approximating 180 degrees because of the minimized separating angles C1, thereby normally closing the electrical circuit of the present invention. If P1 is located in the electrically insulative "spacer 32" area, as dotted line shown, the other two protrusions P2, P3 will be distributed in two opposite contactors 30, ensuring electrical conduction between the terminals 3 and the disk 4.

When tilting (I) the housing 1 of the present invention as shown in FIGS. 4, 5 about a vertical axis Y, to increase the angle to be more than the preset inclination angle A such as dotted line shown in FIG. 4, an initiating angle Ai (Ai >A) will tilt the sloping surface 132 to roll the ball towards the "corner" (lower periphery 121) as shown in FIG. 5, the conducting disk 4 will be upwardly biased to disconnect the two contactors 30 of the terminals 3, thereby opening the circuit. The cover 10 will limit the upward biasing movement of the disk 4 for a smooth inclination of the present invention.

FIG. 5 shows that there is still one protrusion 41 resting upon the terminal 3, with the other two protrusions 41 already leaving the terminals 3, thereby being impossible to close the circuit.

Figure 6:
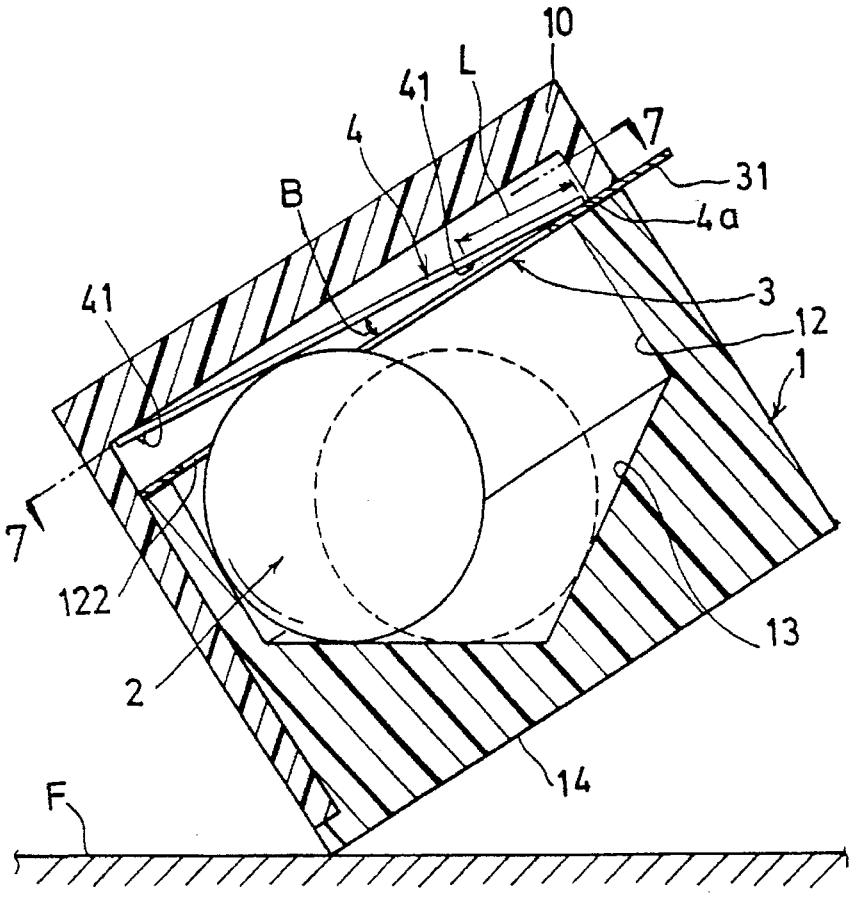
FIG. 6 is an illustration when tilting the present invention having three protrusions of the conducting disk forming an isosceles triangle shape.
Figure 7A:
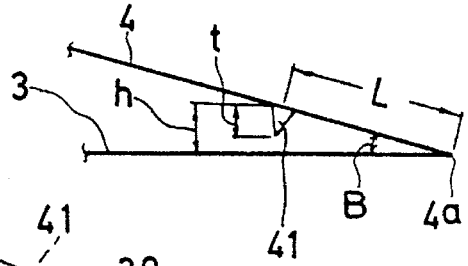
FIG. 7A shows a triangular relationship of the conducting disk with the terminals of the present invention.
Figure 7:
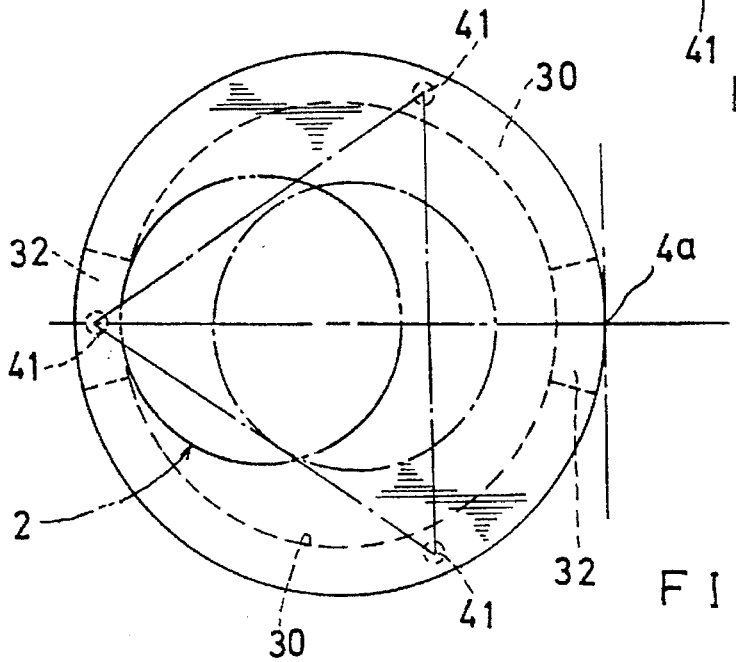
FIG. 7 is a top view of the conductive disk biased on the pair of terminals as viewed from 7—7 direction of FIG. 6.

When the conducting disk 4 is slightly lifted to still rest the two protrusions 41 of an isosceles triangular configuration by the three protrusions 41, as coincidently and occassionally met as shown in FIGS. 7, 6, on the two terminals 3, the circuit will not be disconnected then. For overcoming such a very very rare circumstance, the disk 4 should be upwardly biased at an enough height. For instance, the height h at the protrusion 41 above the terminal 3 should be larger than the height t of the protrusion 41 as shown in FIG. 7A, in which the length L at the protrusion 41 from the fulcrum 4*a*, namely the edge portion of the disk 4, the biasing angle B of the disk 4 as lifted by the ball 2 above the terminal 3, and the "safe" biasing height h should meet the following equation:

$$L \times \text{Sin } B = h;\ h > t$$

$$B = \text{Arc } Sin\ (h/L)$$

Accordingly, the enough biasing height h of the conducting disk 4 to absolutely lift the protrusion(s) 41 of the disk 4 above the terminals 3 will prevent a short-circuiting of the terminals if the ball 2 is actuated by tilting the housing 1 over its inclination angle A.

Figure 10:
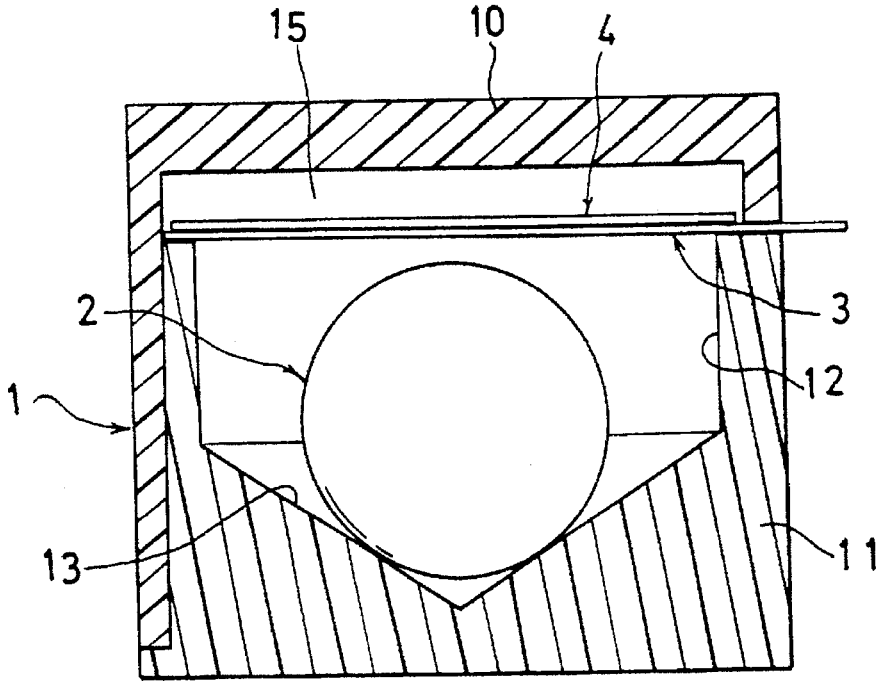
FIG. 10 shows another preferred embodiment of the present invention.
Figure 11:
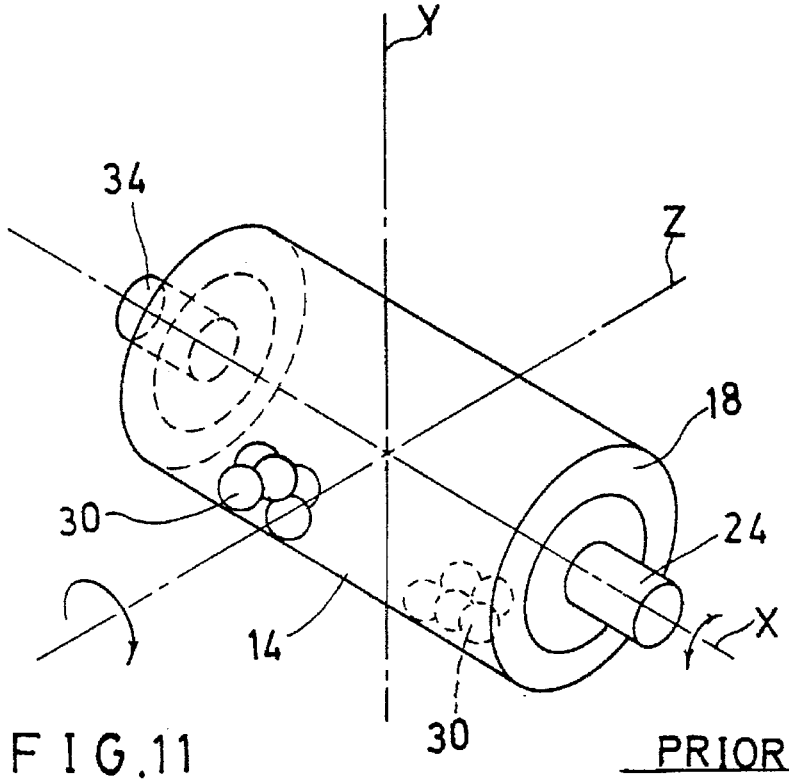
FIG.11 PRIOR ART
FIG. 11 is an illustration showing a conventional tilt switch.

The protrusions 41 of the disk 4 may be eliminated as shown in FIG. 10 if the disk 4 is made rigid without deformation and also formed with mirror bottom surface to ensure a nice contacting with the terminals 3 within the biasing chamber 15 which is clean, dust-proof and even filled with inert gas.

The present invention may be modified without departing from the spirit and scope of this invention.

Figure 10A:
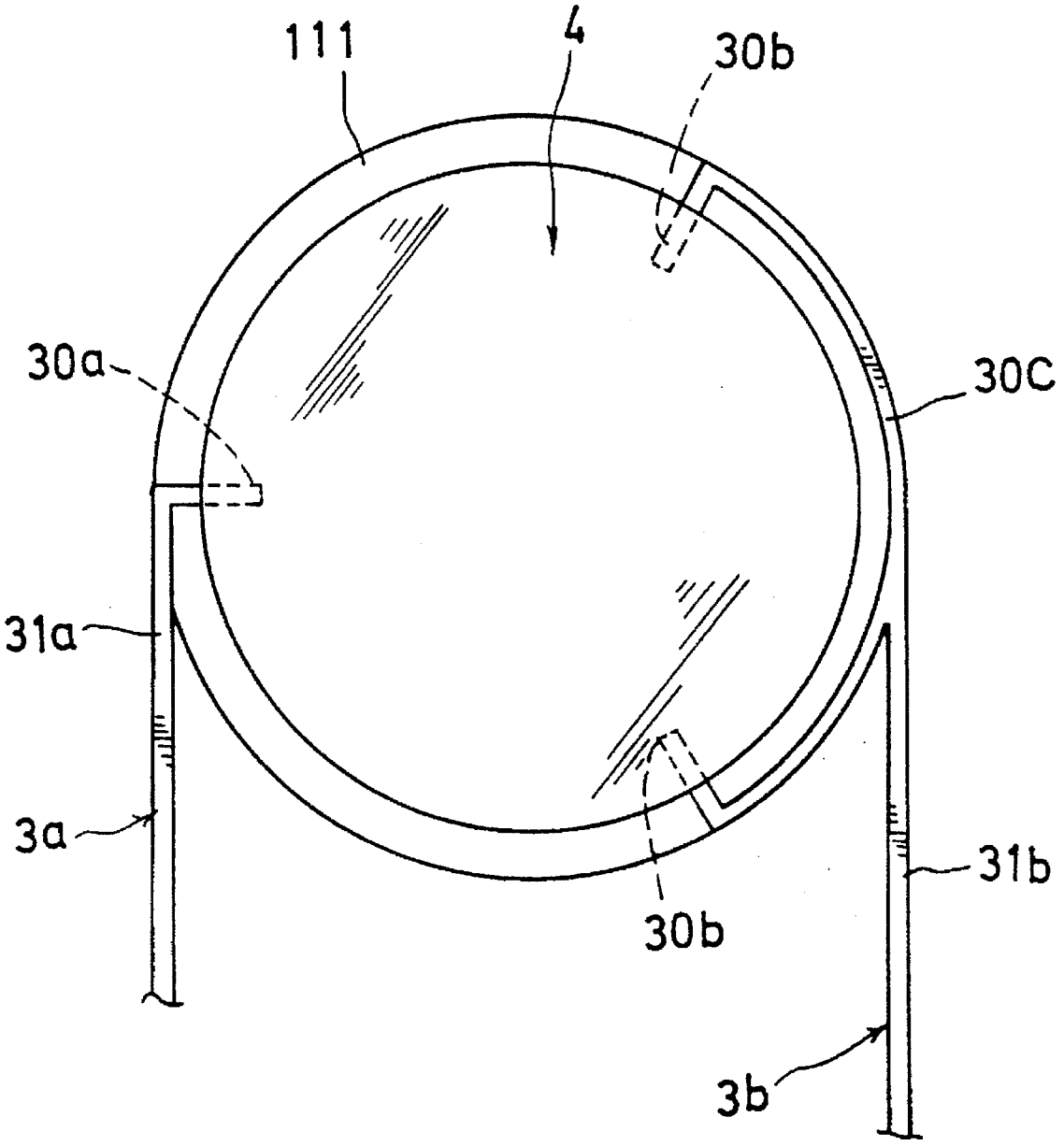
FIG. 10A shows still another preferred embodiment of the present invention.

As shown in FIG. 10A, the two terminals may be modified to include a first terminal 3*a* formed as a first contactor extension 30*a* radially formed on the upper rim portion 111 of the housing 1 and connected with a first contactor lead 31*a*, and a second terminal 3*b* having a second and a third contactor extension 30*b* separated each other at 120 degrees and radially disposed on two end portions of an acuate contactor plate 30*c* secured on the upper rim portion 111 of the housing 1 and connected to a second contactor lead 31*b*, with the first contactor extension 30*a* separating from either second or third contactor extension 30*b* with 120 degrees, with the two contactor leads 31*a*, 31*b* connected to two poles of an electrical circuit. The conducting disk 4 is then formed as a pure circular disk without protrusions.

I claim:

1. An inclination switch comprising:

a housing having a conical recess recessed downwardly in said housing;

an actuating ball normally rested on and operatively moving in said conical recess in said housing;

two terminals separated from each other and respectively electrically connected to two poles of a power source of an electrical circuit, said two terminals secured on an upper portion of said housing; and a conducting disk normally gravitationally riding on said two terminals to close said two terminals for closing the electrical circuit, whereby upon tilting of said housing to move said ball in said housing, said conducting disk will be upwardly biased by said ball to be separated from said two terminals to disconnect said two terminals for opening said electrical circuit.

2. An inclination switch according to claim 1, wherein said housing is made of electrically insulative material and includes: a main body having a cylindrical cavity recessed downwardly from an upper rim portion of the main body with said upper rim portion secured with said two terminals thereon, said conical recess for resting said actuating ball thereon recessed downwardly from a lower periphery of said cylindrical cavity defining a vertical axis longitudinally intersecting a conical center at a lowest center of the conical recess and having a conical sloping surface circumferentially formed on the conical recess, a horizontal bottom formed at a bottom portion of the main body, and a cover encasing the main body and defining a biasing chamber between the cover and the upper rim portion for storing said conducting disk in said chamber, with said conical sloping surface having an inclination angle tilted from the horizontal bottom at an acute angle, whereby upon tilting of said housing in an angle larger than said inclination angle, said ball will be moved in said housing to lift said disk to disconnect the circuit.

3. An inclination switch according to claim 2, wherein said actuating ball is gravitationally held on the conical recess in the housing, said ball having a diameter and an upper spherical portion of said ball positioned lower than the upper rim portion of the housing, whereby upon tilting of said housing, said ball will move on the sloping surface in the conical recess to be braked on the lower periphery between the cylindrical cavity and the conical recess to have said upper spherical portion of the ball to lift the conducting disk upwardly through an upper central opening of the main body in order to leave said terminals to disconnect the terminals for opening the electrical circuit.

4. An inclination switch according to claim 2, wherein said two terminals are circumferentially secured on the upper rim portion of housing; and each said terminal including: an arcuate contactor formed on the upper rim portion of the housing, and a contactor lead protruding outwardly from the arcuate contactor to be connected with the electrical circuit and power source; two said arcuate contactors are separated from each other by an acute separating angle.

5. An inclination switch according to claim 4, wherein said two terminals are separated from each other by a pair of insulative spacers each said spacer defining an acute separating angle.

6. An inclination switch according to claim 1, wherein said conducting disk is formed as a circular shape.

7. An inclination switch according to claim 1, wherein said conducting disk is made of electrically conductive material and includes a plurality of contacting protrusions protruding downwardly from a peripheral bottom portion of the disk to be contactual with said two terminals.

8. An inclination switch according to claim 7, wherein said conducting disk has at least three said contacting protrusions formed thereon with every two neighboring contacting protrusions separated from each other at an angle of 120 degrees about a disk center of said disk.

9. An inclination switch according to claim 2, wherein said two terminals include a first terminal formed as a first contactor extension radially formed on said upper rim portion of said housing and connected with a first contactor lead, and a second terminal having a second and a third contactor extension separated from each other by 120 degrees and disposed on two end portions of an arcuate contactor plate secured on said upper rim portion of said housing and connected to a second contactor lead, said first contactor extension separated from each said second or third contactor extension bar 120 degrees, with said two contactor leads connected to two poles of an electric circuit.

* * * * *